United States Patent [19]

Getz et al.

[11] Patent Number: 4,551,875

[45] Date of Patent: Nov. 12, 1985

[54] COMBINATION TOOL

[75] Inventors: Stephen Getz; William Fouser, both of Michigan City, Ind.

[73] Assignee: International Telephone and Telegraph Corporation, New York, N.Y.

[21] Appl. No.: 199,949

[22] Filed: Oct. 23, 1980

[51] Int. Cl.[4] ..... B25F 3/00

[52] U.S. Cl. ..... 7/138; 7/158; 7/165; 81/437

[58] Field of Search ..... 7/138, 165, 158; 81/177 A, 437, 119 R, 121 R, 52.4 R; D8/26, 29; 403/106, 109, 107, 108; 145/64

[56] References Cited

U.S. PATENT DOCUMENTS

| | | | |
|---|---|---|---|
| 928,312 | 7/1909 | Lloyd | 403/109 |
| 1,203,853 | 11/1916 | Contal | 81/177 A |
| 1,365,851 | 1/1921 | Reynolds | 403/109 |
| 2,438,633 | 3/1948 | Condor | 81/177 A |
| 3,336,611 | 8/1967 | Schepp | 7/158 |
| 3,452,373 | 7/1969 | Vosbikian et al. | 7/138 |
| 3,932,904 | 1/1976 | Nilsson et al. | 7/165 |
| 3,965,510 | 6/1976 | Ernst | 7/165 |

FOREIGN PATENT DOCUMENTS

| | | | |
|---|---|---|---|
| 84665 | 3/1958 | Denmark | 7/165 |

*Primary Examiner*—Roscoe V. Parker
*Attorney, Agent, or Firm*—James B. Raden

[57] ABSTRACT

A combination tool having a central shaft which may be rotated by a power tool. The shaft has a drill bit mounted in its front end so that rotation of the shaft causes rotation of the bit. The shaft is fitted in the bore of a sleeve or tube, the tube having a nut driver socket head at its front end. By advancing the tube on the shaft, complementary flats on the shaft and in the rear of the tube are mated to couple the shaft to the tube in a driving relation. The tube may be advanced to recess the drill bit within the tube to free the socket for use in a socket driving tool.

3 Claims, 13 Drawing Figures

COMBINATION TOOL

BACKGROUND OF THE INVENTION

Combination tools of the type shown herein are generally known as can be seen from such U.S. Pat. Nos. 3,336,611 issued to R. Schepp et al on Aug. 22, 1967; 3,965,510 issued June 29, 1976 to Ernst; 3,452,373 issued July 1, 1969 to Vosbikian et al; and 3,932,904 issued Jan. 20, 1976 to Nilsson et al.

Some of these tools are designed for manual use while others are adapted for machine or power drive, the general construction and operation being somewhat similar. In these patents, there is an inner shaft to which a screw driver bit or drill bit is affixed. The shaft is fitted within a tubular sleeve that is retractable to a first position with the bit extending out of the sleeve and the tube is advanceable to a second position in which the bit is recessed within the sleeve. In the latter position, a socket at the free end of the sleeve may be used as a driver for a headed fastener, nut or the like.

With the sleeve in the first position, the sleeve generally is coupled to the shaft to enable the sleeve to rotate on rotation of the shaft. The means of providing the engagement and advanced position maintenance form the novel features of the tools shown by the references and the known art.

Tools of this type have special application in the concrete and masonry fastener industry where a hole is drilled in masonry and a headed anchor screw (hex or square) is driven into the drilled hole. In the use of such tools, the drilling operation releases a considerable amount of concrete dust which sould be prevented from entering the tool as much as possible. The tool must allow the ready replacement of replaceable elements such as drill bits and driving sockets, yet these elements must be held firmly in place to complete the desired operations. The tool must be capable of ready shifting between its two operating positions and must remain in the position into which it is set.

SUMMARY OF THE INVENTION

The invention is directed to an improved combination dual action tool adapted to be power driven, for such dual actions as drilling and power socket driving.

The combination tool of the present invention provides a combination tool such as a drill and socket driver in which the driving shaft has a generally cylindrical body with an axially elongated flat wall for mating with a flat area of a collar at the rear of a support tube for the tool. By keying the flat wall with the flat area of the collar, the shaft is coupled to the tube for joint rotation.

Near the front end of the flat wall of the shaft, a second flat of short axial extent is formed at a 90° angle to the axially elongated wall. A radial transition area joins the flats. In shifting the tool to the socket driving position, the tube is advanced and thereafter rotated 90° through the transition area to couple the short extent flat area with the flat of the collar. Shoulders at the front and rear ends of the short extent flat area engage the edges of the collar to position the tube in the socket driving position. The engagement of shoulder and collar edge enable force to be applied axially at the socket end of the tube.

In the drilling position, the tube is retracted so that the bit is exposed beyond the end of the tube. The shaft is directly connected to the power source to rotate the shaft. The flatted keyed wall of the shaft engages the flatted area of the collar to cause rotation of the tube with the shaft. Axial positioning of the tube relative to the shaft is maintained by a ball in a radial opening of the tube wall riding in a peripheral V groove about the shaft. The ball in groove engagement holds the tube normally. The engagement may be overcome by a sharp axial tap to allow the tube to be advanced toward the socket driving position.

It is therefore an object of the invention to provide an improved combination tool in which a bit-bearing shaft is mounted within a mating tube with the tube axially slidable between a retracted position with the shaft coupled to a rear collar of the tube in mutually rotatable relationship and an advanced position in which spaced shoulders on the shaft straddle and engage one side of the collar to hold the shaft recessed within the tube. In this position the tube is coupled for rotation with the shaft.

It is a still further object of the invention to provide a combined tool in which there is a central shaft adapted to have one end power rotated and bearing a rotatable bit at the other end, the bit rotating with the shaft. A tube surrounding the axial central portion of shaft may be advanced to expose a shaped, fastener-driving tubular socket at the front end of the tube. The tube is coupled to the shaft for rotation therewith by flat key area in the sidewall of the shaft engaging a collar on the tube.

Other objects, features and advantages of the invention will become apparent from the drawings described briefly thereafter viewed in conjunction with the following detailed description.

BRIEF DESCRIPTION

Figure 1:
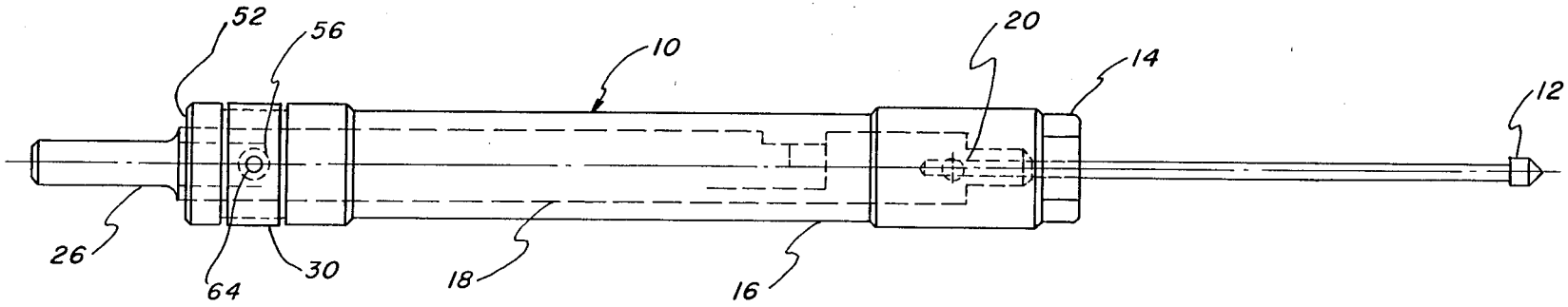
FIG. 1 is a side elevational view of our tool in a drilling condition.
Figure 2:
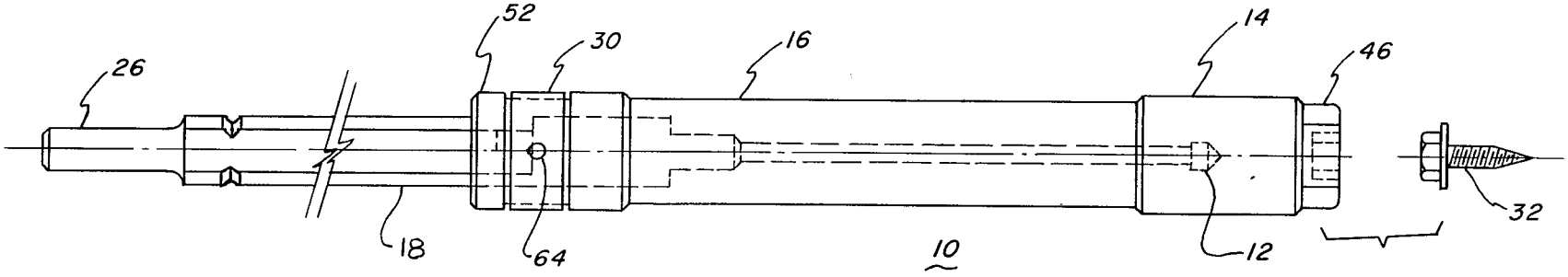
FIG. 2 is a side elevational view of the tool of FIGS. 1 and 2, in a socket driving condition.
Figure 12:
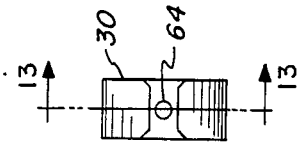
Figure 13:
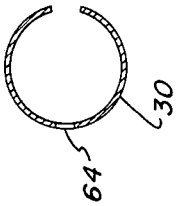
Figure 6:
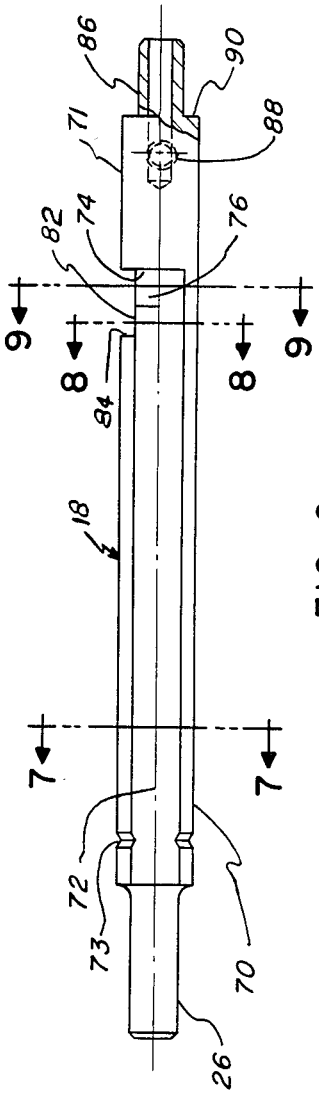
FIG. 6 is a side view in elevation of the shaft of FIGS. 1 and 2.
Figure 11:
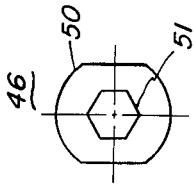
Figure 10:
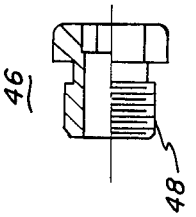
Figure 9:
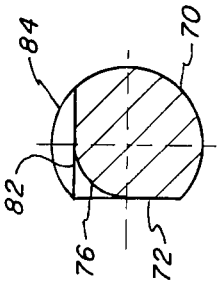
Figure 8:
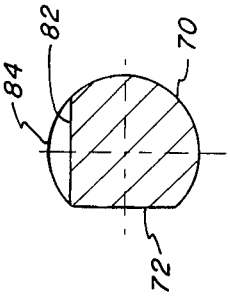
Figure 7:
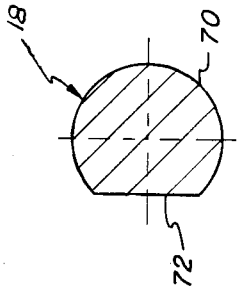

FIGS. 7, 8 and 9 are respective sectional views along lines 7—7, 8—8, and 9—9 respectively in FIG. 6;

FIG. 10 is a sectional view of the driving socket of FIGS. 1 and 2;

FIG. 11 is a front end view in elevation of the socket of FIGS. 1 and 2; and FIGS. 12 and 13 are respctively a front view in elevation of the retainer ring and a section viewed along line 13—13 of FIG. 12.

DETAILED DESCRIPTION

In FIG. 1, we show our tool 10 in a drilling position with the drill bit 12 extending beyond the front end 14 of the tube or sleeve 16. The drill bit is affixed at the end of an axially elongated main shaft 18, the bit being mounted within a blind socket 20 in the front end of main shaft 18. The main shaft 18 (fabricated of suitable material such as zinc plated steel) is telescopically positioned within the bore of tube 16 with the rear section 26 of the main shaft extending axially past of the rear end of the tube 16. The rear section 26 of the main shaft is adapted to mount in the chuck of a rotary power tool (not shown).

With the tool 10 in the drilling position of FIG. 1, rotation of the main shaft rear section 26 directly causes rotation of the main shaft 18 and drill bit 12. During such rotation, the tube 16 rotates with the main shaft 18 due to a coupling to be described later herein. The axial relationship between tube and shaft is held by a holding action of spring retainer ring 30 on the shaft as will be explained.

In FIG. 2, we show our tool 10 in a nut driving or socket driving position with the drill bit 12 recessed within the tube bore. The front end of the tube bears a socket 46 configured with a hex or other nut or fastener driving configuration. The center bore of the tube and socket 46 is open and unencumbered to enable the tube to slide axially telescopically along the shaft and clear the bore of the socket to allow a headed fastener such as hex headed screw 32 to be held within the hex socket opening. Such screws may have a flange below the head to hold the screw head in the socket entrance. The tube 16 is coupled to the shaft 18 to cause rotation of the socket 46 on rotation by the power tool of shaft rear section 26.

Figure 5:
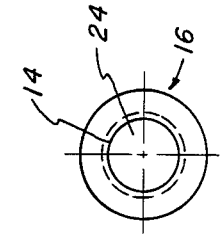
FIGS. 3–5 are respectively rear, side and front elevational views of the tube of FIGS. 1 and 2, the side view being partially broken away to show the interior thereof.
Figure 4:
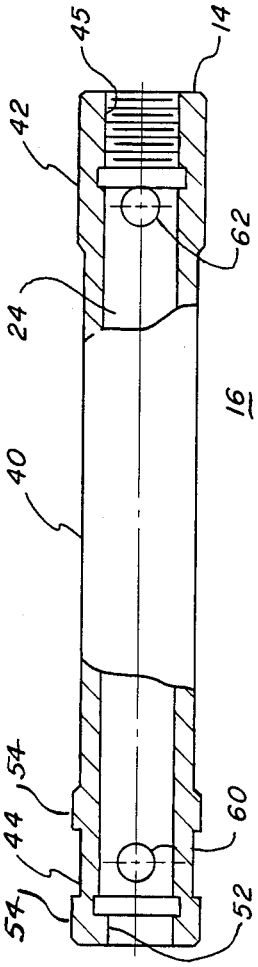
Figure 3:
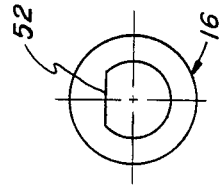

In FIGS. 3–5, we show the tube 16 in greater detail. The tube 16 is shown having a central body 40 with a front cap 42 and a rear cap 44 at the outer axial ends. The bore 24 through the central body 40 is an open cylindrical bore. Front cap 42 has its inner surface 45 threaded to receive one end of the nut or fastener driving socket member 46. The socket member 46 (FIGS. 10 and 11) has an externally threaded section 48 leading to the front headed end 50 configured with a suitable internal hex shape 51. The central bore of the socket 46 is also open to allow the drill bit to pass therethrough for one condition as desired, and to receive the headed fastener in its other condition.

In the area of rear cap 44, the bore 24 of the tube is essentially a cylindrical open bore continuation. At its rearmost end the cap 44 is configured with an inner key collar 52 which encloses or blocks a segment of the bore (FIG. 3) for a finite axial distance which may be 3/16 of an inch. The outer wall of rear cap 44 has axially spaced circumferential ridges 54 for retaining spring retainer 30 in place between the ridges.

The cap sections 42 and 44 may be fabricated as integral portions of tube body 40 or may be separate members suitably secured to the tube body. Preferably, the tube including cap sections is integrally fabricated of suitable material such as a commercial zinc plated steel such as 13/16" stock with approximately one half inch bore therethrough.

Each of the cap sections 42 and 44 has a radial opening in the wall thereof communicating with the tube bore. Within the rear cap 44, radial opening receives a ball 56 to bear against the shaft. The spring 30 bears against the outside of the ball, the spring having an opening less than the diameter of the ball 56 to couple the main shaft to the tube. Rotation of the rotary power tool rotates the main shaft, the drill shaft and the drill bit due to the direct drive connection, and the tube due to the coupling of the keyed collar to shaft. The tube is held in this position by the ball bearing 56 held by spring 30 in "v" groove 73.

The main shaft 18 as shown in FIGS. 6–9 may be considered as having three axial sections, the reduced diameter rear section 26 adapted for chucking in a rotary power drive implement, the central section 70 and the front area 71 adjacent socket 20.

The reduced diameter rear shaft section 26 as mentioned, may be shaped as necessary to fit in the chuck of a rotary power tool for rotating the shaft. The shaft central section 70 is essentially cylindrical and of greater diameter than the chucking end. From the chucking section, the central section has a flat or main keyway 72 in its sidewall extending axially for virtually the entire length of the central section forming a circular segment cross section. The flat or keyway terminates in a shoulder 74, forward of which the front area is of circular cross section, the front area being otherwise an extension of the cylinder of the central section.

Rearward of shoulder 74, the one edge 76 of the keyway is suitably formed with a radius in a transition area leading from keyway 72 to a second flat or keyway 82 substantially at right angles to flat key wall 72. The second keyway is of comparatively short axial length, its axial length including the radially arcuate area 76 and continuing within a rearwardly directed segment wall area 82, the areas 76 and 82 each being of approximately the same axial length. The segmental wall area 82 is greater in axial length than the axial length of the tube key segment 52. The area 82 terminates at its rearward end in the shoulder 84 formed by the junction of the area 82 with the cylindrical body of the central section.

The front portion 71 of the main shaft 22 is stepped down to a smaller diameter section 86 at its frontmost end, the front portion being formed with the axial blind socket for receiving drill bit 12. A set screw opening 88 having access to the socket is provided for receiving a set screw locking the drill bit in place in a manner allowing replacement of the drill shaft and drill bit, when necessary.

FIGS. 12 and 13 show in greater detail the spring retainer 30 which is essentially C-shaped in cross section with a circular opening 64 diametrically opposite the C opening. The opening is sized to hold a ball bearing against the shaft within the V groove 73, as can be seen in FIGS. 1 and 2.

In operation, the present tool is capable of being placed into two conditions, one for drilling and the second for nut or hex-headed screw driving. In either condition, the shaft rear end is adapted to be mounted in the chuck of a rotary power driving tool. In either condition, the tube 16 is coupled to the main shaft 18 for rotation therewith.

With the drill shaft and drill bit exposed forward of the tube in the drilling condition, the main keyway 72 on the shaft mates with the key segment collar 52 to couple the tube to the main shaft 18. Rotation of the rotary power tool rotates the main shaft, the drill shaft and the drill bit due to the direct drive connection. The tube is held in a retracted position exposing the drill by the holding force imposed by ball 56 on the shaft 18.

When the socket tip of the tube is to be used, the holding force of the ball bearing 56 in V groove 73 must be released. The tube is pushed forwardly on the main shaft to the position where the key segment collar of the tube is in alignment axially with the curved radial transition area 76. The tube may then be rotated counterclockwise (as viewed from the rear) by 90° to place the tube key segment 52 in engagement with the second keyway 82 on the shaft. Thereafter, the tube is pulled axially rearwardly to maintain the key collar segment 52 of the shaft in registry with the second keyway 82. The key segment 52 will rest on the keyway 82 adjacent the rear shoulder 84. The shaft is recessed within the tube and the socket hex opening is unencumbered and available for use. Driving force may be applied to the hex socket member at the front of the tube with a hex screw or nut mounted in the hex opening. The tube collar 52 is held between the shoulders 84 and 74 enabling forward pressure to be applied to the screw or nut being driven by the tube socket.

The combination tool employing these features has a closed outer tube preventing dust from entering the tube bore. The tool can be readily converted from one function to another without the need for additional tools and can be readily disassembled for maintenance, if necessary.

We claim:

1. A combination tool for selectively exposing a power-driven bit member at one axial end of the tool or a socket member at the one axial end of the tool, comprising a shaft bearing said bit member at its free end and a tube bearing said socket member at the free end thereof, said tube telescopically coupled to the shaft for rotation therewith on the driving of said shaft with either of said members exposed, the invention wherein said tube has a socket member with a configured central opening at the free end thereof and an internally segmented collar at the other end of the tube, a cylindrical bore in the tube between the ends thereof, said shaft being generally cylindrical with an axially elongated segmental flat keywall extending from adjacent the driven end of the shaft to a shoulder adjacent to and spaced from the bit end of the shaft, said shaft keywall shaped to mate with the segmented collar in a planar mating to engage the tube to the shaft for rotation therewith with the bit end of said shaft extending past the one end of the tube, a second flat keywall on said shaft adjacent said shoulder and terminating at a second shoulder spaced from said first mentioned flat keywall, said second keywall positioned on said shaft to mate with the segment of said collar in an advanced position with the free end of the tube advanced axially along the shaft and in which the mating of the second keywall to said collar engages the shaft to the collar for mutual rotation, and in which said second shoulder is positioned to abut against said collar to maintain the tube in said advanced position.

2. A tool as claimed in claim 1 in which both said keywalls comprise flattened areas on the sidewall of the cylindrical shaft and the keyed collar comprises a segment within the collar for mating with the elongated or the second keywall.

3. A tool as claimed in claim 2, in which said elongated and second keywalls are aligned radially 90° from one another with a radial transition area joining both areas.

* * * * *